US011174746B2

(12) United States Patent
Taniguchi et al.

(10) Patent No.: US 11,174,746 B2
(45) Date of Patent: Nov. 16, 2021

(54) STATOR VANE FOR STEAM TURBINE, STEAM TURBINE, AND METHOD FOR HEATING STATOR VANE FOR STEAM TURBINE

(71) Applicant: MITSUBISHI HEAVY INDUSTRIES, LTD., Tokyo (JP)

(72) Inventors: Nao Taniguchi, Tokyo (JP); Ryo Takata, Tokyo (JP); Tsuyoshi Kitamura, Tokyo (JP); Yuichiro Hirano, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/782,233

(22) Filed: Feb. 5, 2020

(65) Prior Publication Data

US 2021/0010379 A1 Jan. 14, 2021

(30) Foreign Application Priority Data

Jul. 10, 2019 (JP) ..... JP2019-128353

(51) Int. Cl.
*F01D 9/04* (2006.01)
*F01D 25/10* (2006.01)
(Continued)

(52) U.S. Cl.
CPC ..... *F01D 9/041* (2013.01); *F01D 5/08* (2013.01); *F01D 5/18* (2013.01); *F01D 25/10* (2013.01);
(Continued)

(58) Field of Classification Search
CPC . F01D 9/041; F01D 9/065; F01D 9/02; F01D 1/04; F01D 5/08; F01D 5/18;
(Continued)

(56) References Cited

U.S. PATENT DOCUMENTS 5,342,172 A * 8/1994 Coudray ..... F01D 5/186 416/95
2014/0030065 A1 1/2014 Nakano et al.
(Continued)

FOREIGN PATENT DOCUMENTS

JP 3-233109 A 10/1991
JP 8-210104 A 8/1996
(Continued)

*Primary Examiner* — J. Todd Newton
*Assistant Examiner* — Eric J Zamora Alvarez
(74) *Attorney, Agent, or Firm* — Westerman, Hattori, Daniels & Adrian, LLP

(57) ABSTRACT

A stator vane for a steam turbine includes: a vane body having an airfoil cross section including a pressure-side partition wall having a concave surface shape and a suction-side partition wall having a convex surface shape, the vane body having a hollow section formed between an inner surface of the pressure-side partition wall and an inner surface of the suction-side partition wall; and a first division wall dividing the hollow section into a first hollow section positioned at a leading edge side and a second hollow section positioned at a trailing edge side. The first hollow section is configured to be supplied with a fluid, or as a sealed space, and a slit is formed on at least one of the pressure-side partition wall or the suction-side partition wall, the slit being in communication with the second hollow section.

6 Claims, 16 Drawing Sheets

(51) Int. Cl.

| | |
|---|---|
| ***F01D 5/08*** | (2006.01) |
| ***F01D 5/18*** | (2006.01) |
| ***F01D 25/32*** | (2006.01) |
| ***F01D 9/02*** | (2006.01) |
| ***F01D 25/08*** | (2006.01) |
| ***F01D 25/00*** | (2006.01) |

(52) U.S. Cl.
CPC ..... *F05D 2220/31* (2013.01); *F05D 2240/12* (2013.01); *F05D 2240/24* (2013.01); *F05D 2260/232* (2013.01)

(58) Field of Classification Search
CPC . F01D 5/28; F01D 5/145; F01D 5/147; F01D 5/185; F01D 5/187; F01D 5/188; F01D 5/189; F01D 25/10; F01D 25/32; F05D 2220/31; F05D 2240/12; F05D 2240/123; F05D 2240/24; F05D 2240/124; F05D 2260/232; F05D 2260/2322; F05D 2260/602; F05D 2260/22; F05D 2260/205; Y10T 29/49339
See application file for complete search history.

(56) References Cited

U.S. PATENT DOCUMENTS

| | | | |
|---|---|---|---|
| 2016/0146057 | A1 | 5/2016 | Takata et al. |
| 2017/0130584 | A1 | 5/2017 | Maruyama |

FOREIGN PATENT DOCUMENTS

| | | | |
|---|---|---|---|
| JP | 10-103008 | A | 4/1998 |
| JP | 2013-124561 | A | 6/2013 |
| JP | 2014-25443 | A | 2/2014 |
| JP | 2019-44728 | A | 3/2019 |
| WO | 2015/015858 | A1 | 2/2015 |
| WO | 2015/198853 | A1 | 12/2015 |

* cited by examiner

STATOR VANE FOR STEAM TURBINE, STEAM TURBINE, AND METHOD FOR HEATING STATOR VANE FOR STEAM TURBINE

TECHNICAL FIELD

The present disclosure relates to a stator vane for a steam turbine, a steam turbine, and a method for heating a stator vane for a steam turbine.

BACKGROUND ART

In a steam turbine that operates in a gas-liquid two-phase state, moisture loss and erosion may occur due to existence of coarse droplets formed on vane surfaces. As a root-cause mechanism of formation of coarse droplets, typically known is turbulence deposition of droplets due to turbulence diffusion inside the vane-surface boundary layer or inertia adhesion to the vane surfaces due to the inertia force of droplets. Besides these, considered as a main cause is wall surface condensation that occurs at wall surfaces that have a relatively low temperature compared to steam.

Measures have been proposed to suppress coarse droplets on stator vane surfaces, which include a method of forming a hollow section inside a stator vane and forming a slit that is in communication with the hollow section on the vane surface to suck in a liquid film formed of coarse droplets accumulating on the vane surface into the inside of the stator vane through the slit (see Patent Document 1), and a method of causing a high-temperature fluid to flow through the hollow section to heat the vane surface and evaporate droplets adhering to the vane surface (see Patent Document 2).

CITATION LIST

Patent Literature

Patent Document 1: JP2014-25443A
Patent Document 2: JP2019-44728A

SUMMARY

The above measures may be effective in a case where droplets formed on the stator vanes of an upstream-side turbine stage adhere to the vane surfaces of downstream-side stator vanes, but are not effective for wall surface condensation that may occur at any stage.

The present disclosure was made in view of the above, and an object of the present disclosure is to propose a measure that is effective for coarse droplets that develop on stator vane surfaces due to the above described wall surface condensation.

To achieve the above object, a stator vane for a steam turbine according to the present disclosure includes: a vane body having an airfoil cross section including a pressure-side partition wall having a concave surface shape and a suction-side partition wall having a convex surface shape, the vane body having a hollow section formed between an inner surface of the pressure-side partition wall and an inner surface of the suction-side partition wall; and a first division wall dividing the hollow section into a first hollow section positioned at a leading edge side and a second hollow section positioned at a trailing edge side, wherein the first hollow section is configured to be supplied with a fluid, and a slit is formed on at least one of the pressure-side partition wall or the suction-side partition wall, the slit being in communication with the second hollow section.

Furthermore, a stator vane for a steam turbine according to the present disclosure includes: a vane body having an airfoil cross section including a pressure-side partition wall having a concave surface shape and a suction-side partition wall having a convex surface shape, the vane body having a hollow section formed between an inner surface of the pressure-side partition wall and an inner surface of the suction-side partition wall; and a first division wall dividing the hollow section into a first hollow section positioned at a leading edge side and a second hollow section positioned at a trailing edge side, wherein the first hollow section is configured to be a closed space, and a slit is formed on at least one of the pressure-side partition wall or the suction-side partition wall, the slit being in communication with the second hollow section.

Furthermore, a steam turbine according to the present disclosure includes: a turbine stage including a stator vane row having a plurality of stator vanes disposed around a turbine rotor, and a rotor blade row including a plurality of rotor blades disposed around the turbine rotor at a downstream side of the stator vane row with respect to a flow direction of a working fluid, and at least a part of the plurality of stator vanes forming the stator vane row includes the stator vane for a steam turbine described above.

Furthermore, a method of heating a stator vane for a steam turbine according to the present disclosure includes a preparation step of placing, in a steam flow passage of a steam turbine, a stator vane for a steam turbine comprising a vane body having an airfoil cross section including a pressure-side partition wall having a concave surface shape and a suction-side partition wall having a convex surface shape, the vane body having a hollow section formed between an inner surface of the pressure-side partition wall and an inner surface of the suction-side partition wall; and a first division wall dividing the hollow section into a first hollow section positioned at a leading edge side and a second hollow section positioned at a trailing edge side, wherein a slit is formed on at least one of the pressure-side partition wall or the suction-side partition wall, the slit being in communication with the second hollow section; and a heating step of supplying a heating liquid to the first hollow section.

With the stator vane for a steam turbine, the steam turbine, and the method for heating a stator vane for a steam turbine according to the present disclosure, it is possible to suppress formation of coarse droplets due to wall surface condensation or the like on a stator vane surface. Accordingly, it is possible to suppress moisture loss and erosion of rotor blades.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

First Embodiment (Configuration of Steam Turbine)

Figure 1:
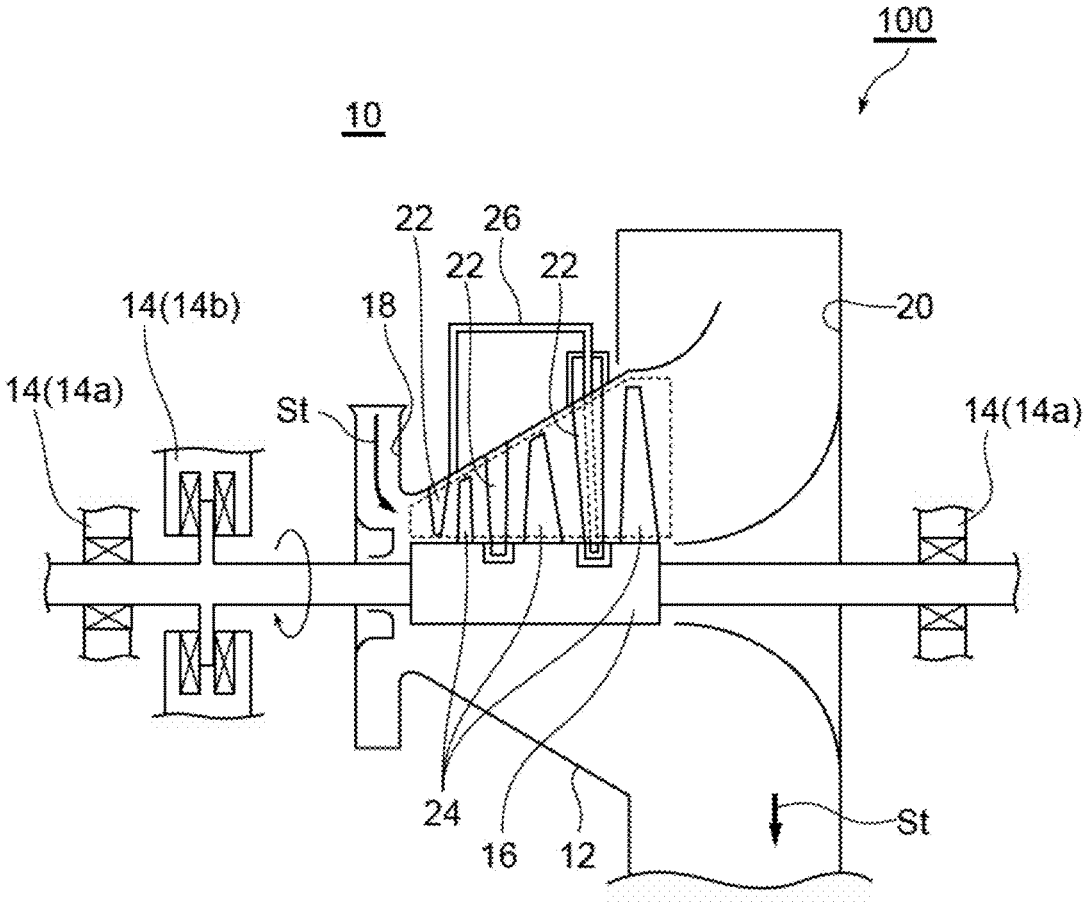
FIG. 1 is a schematic vertical cross-sectional view of a steam turbine according to an embodiment.
Figure 2:
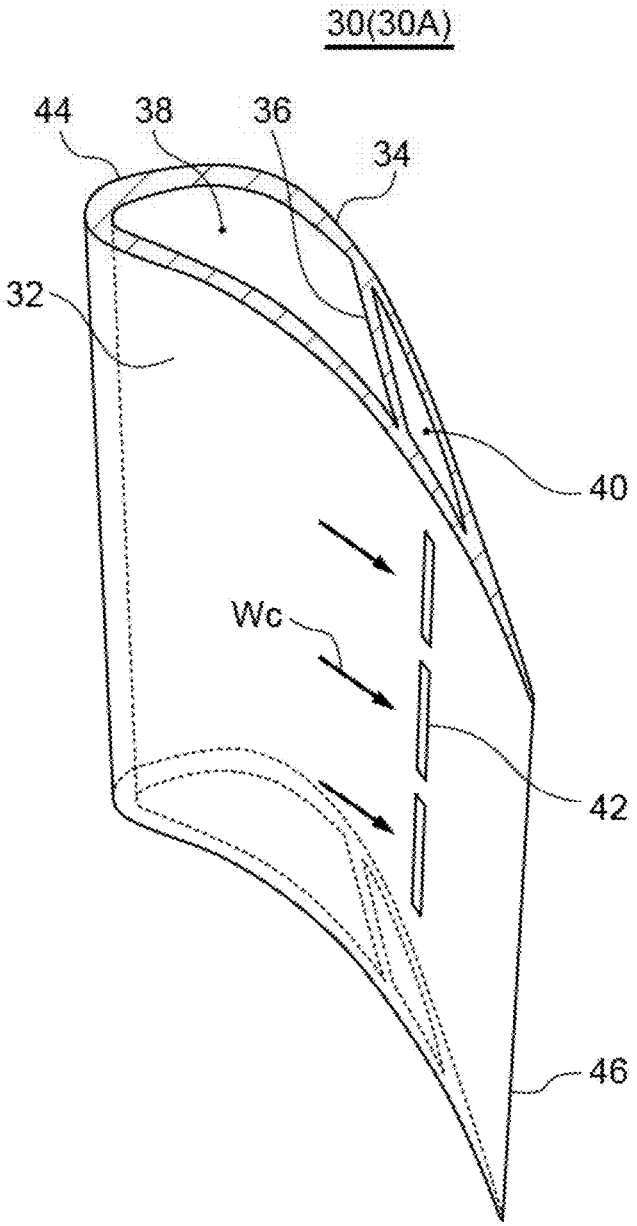
FIG. 2 is a perspective view of a stator vane according to an embodiment.

FIG. 1 is a schematic vertical cross-sectional view of a steam turbine 10 according to an embodiment. The steam turbine 10 according to the present embodiment is a low-pressure turbine. The steam turbine 10 includes a casing 12, and a turbine rotor 16 supported rotatably by a bearing 14 inside the casing 12. The bearing 14 includes a journal bearing 14 (14*a*) and a thrust bearing 14 (14*b*). The casing 12 has an internal space that is sealed air-tightly, and a flow passage of main steam St is formed inside the internal space. A steam inlet portion 18 is disposed on an upstream portion of the main steam flow passage of the casing 12. A steam outlet portion 20 for discharging the main steam St after flowing through the inside of the casing 12 to the outside is disposed on a downstream portion of the main steam flow passage of the casing 12.

The steam turbine 10 includes a turbine stage including a plurality of stator vane rows 22 and a plurality of rotor blade rows inside the casing 12. The stator vane rows 22 and the rotor blade rows 24 are disposed alternately along the flow direction of the main steam St in the main steam flow passage. Each stator vane row 22 includes a plurality of stator vanes disposed around the turbine rotor 16, and the stator vanes are fixed to the side of the casing 12. Each rotor blade row 24 includes a plurality of rotor blades disposed around the turbine rotor 16, and the blade rows are fixed to the turbine rotor 16.

As the main steam St is supplied from the steam inlet portion 18 and flows through the steam flow passage, the main steam St is rectified while flowing between the plurality of stator vanes forming the stator vane rows 22. The rectified main steam St rotary drives the turbine rotor 16 via the rotor blades forming the rotor blade rows 24 disposed at the downstream side of the stator vane rows 22.

Figure 17:
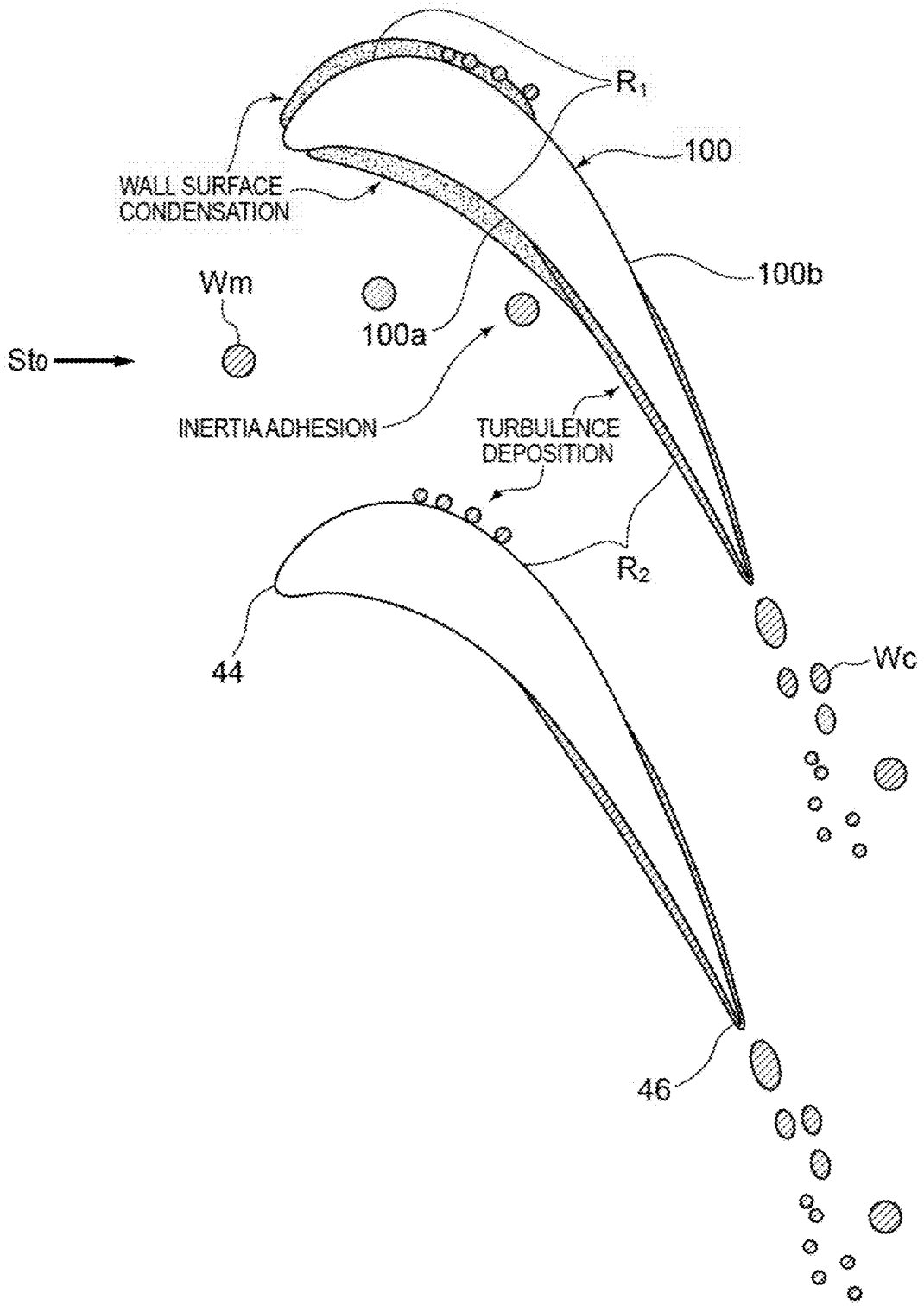
FIG. 17 is a diagram showing a mechanism of formation of coarse droplets on a stator vane surface.

FIG. 17 is a diagram showing a mechanism of formation of coarse droplets on a stator vane surface. The moisture steam St0 containing small droplets Wm adheres to the stator vane 100 due to the inertia force. Furthermore, in the vane surface region $R_2$ at the downstream side of the pressure-side surface 100*a* or at the upstream side of the suction-side surface 100*b*, due to turbulence diffusion in the boundary layer, the vane-surface turbulence deposition of fine droplets Wm occurs. Furthermore, wall surface condensation occurs in the vane surface region $R_1$ at the upstream side of the pressure-side surface 100*a* of the stator vane 100. The droplets accumulated on the vane surface form a liquid film and flow downstream, become coarse droplets We and scatter downstream from the trailing edge of the stator vane 100, thereby causing moisture loss and erosion of rotor blades.

(Configuration of Stator Vane)

First Embodiment

Hereinafter, the configuration of a stator vane according to some embodiments will be described with reference to FIGS. 2 to 9. The stator vane 30 (30A, 30B, 30C, 30D) depicted in FIGS. 2 to 9 is disposed at the downstream side of the steam flow passage, and has an airfoil cross section, for instance. The airfoil cross section includes a pressure-side partition wall 32 having a concave shape and a suction-side partition wall 34 having a convex shape. The vane body of the stator vane 30 (30A to 30D) includes a hollow section 38 (first hollow section) formed between the inner surface of the pressure-side partition wall 32 and the inner surface of the suction-side partition wall 34. The hollow section 38 is divided by a division wall 36 (first division wall) into a hollow section 38 (first hollow section) positioned at the leading edge side and a hollow section 40 (second hollow section) positioned at the trailing edge side. The hollow section 38 is configured to be supplied with a heating fluid. Furthermore, a slit 42 is formed on at least one of the pressure-side partition wall 32 or the suction-side partition wall 34, and the slit 42 is in communication with the hollow section 40.

With the above embodiment, by supplying a heating fluid to the hollow section 38 during operation of the steam turbine 10 to heat the stator vane surface at the leading edge side, it is possible to suppress formation of coarse droplets Wc on the stator vane surface due to wall surface condensation or the like. Furthermore, the coarse droplets Wc adhering to the stator vane surface flow into the hollow section 40 from the slit 42, and are removed from the stator vane surface. Accordingly, it is possible to suppress scattering of the coarse droplets Wc to the downstream side from the trailing edge of the stator vane, and thereby it is possible to suppress moisture loss and erosion of the rotor blades due to scattering of the coarse droplets.

In an embodiment, as the heating fluid to be supplied to the hollow section 38, a part of the main steam St flowing through the upstream side of the position of the stator vane 30 in the steam flow passage is used. For instance, as depicted in FIG. 1, a high-temperature steam introduction pipe 26 is disposed so as to be in communication with the upstream-side steam flow passage and the hollow section 38 of the stator vane 30 (30A to 30D), and the upstream side high temperature steam is supplied to the hollow section 38 via the high-temperature steam introduction pipe 26.

Furthermore, in another embodiment, with the hollow section 40 having a negative pressure, the coarse droplets Wc on the stator vane surface are sucked into the hollow section 40 via the slit 42. In this case, for instance, the hollow section 40 is configured to be in communication with the inside of a condenser (not depicted) disposed at the downstream side of the steam flow passage. Accordingly, it is possible to cause the hollow section 40 to have a negative pressure equivalent to that of the inside of the condenser. With the hollow section 40 having a negative pressure, it is possible to suck the coarse droplets We formed on the stator vane surface into the hollow section 40 via the slit 42.

Figure 4:
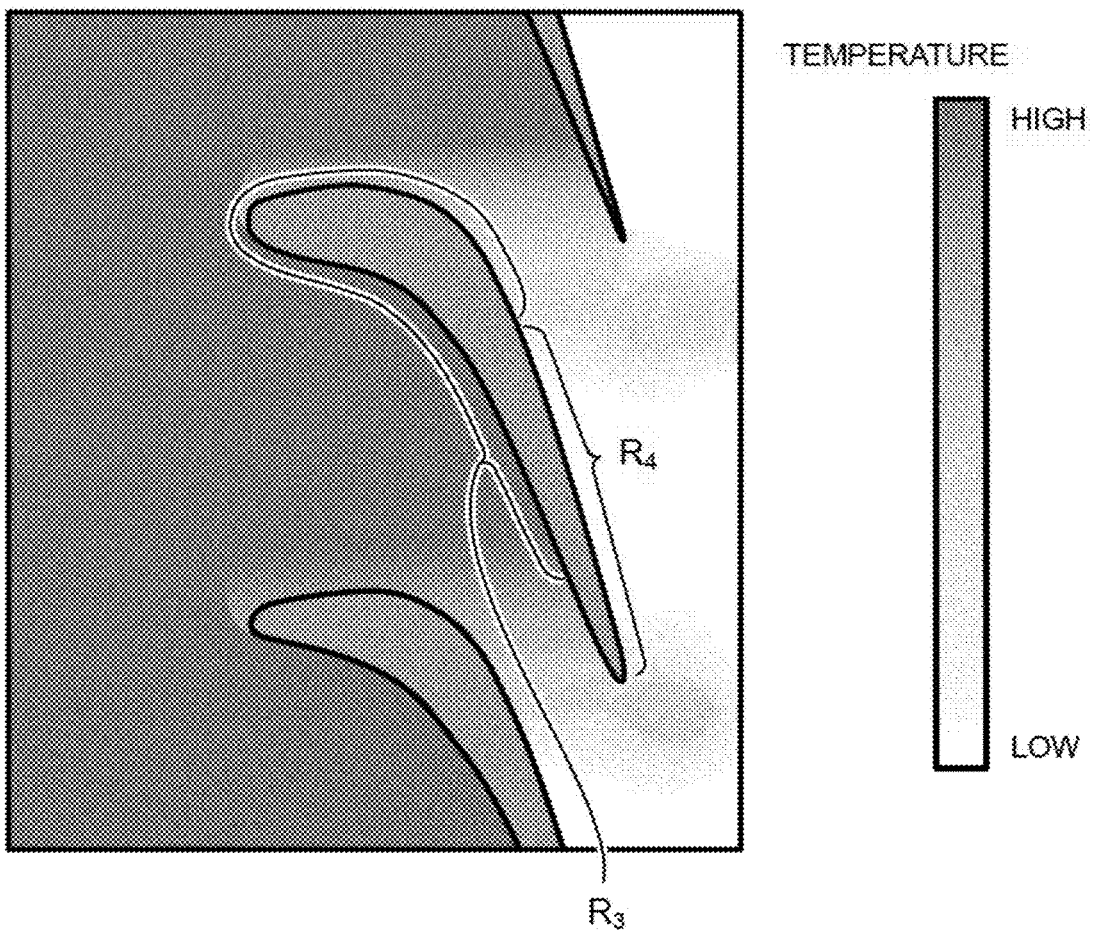
FIG. 4 is a temperature distribution diagram showing the static temperature distribution around stator vanes.
Figure 5:
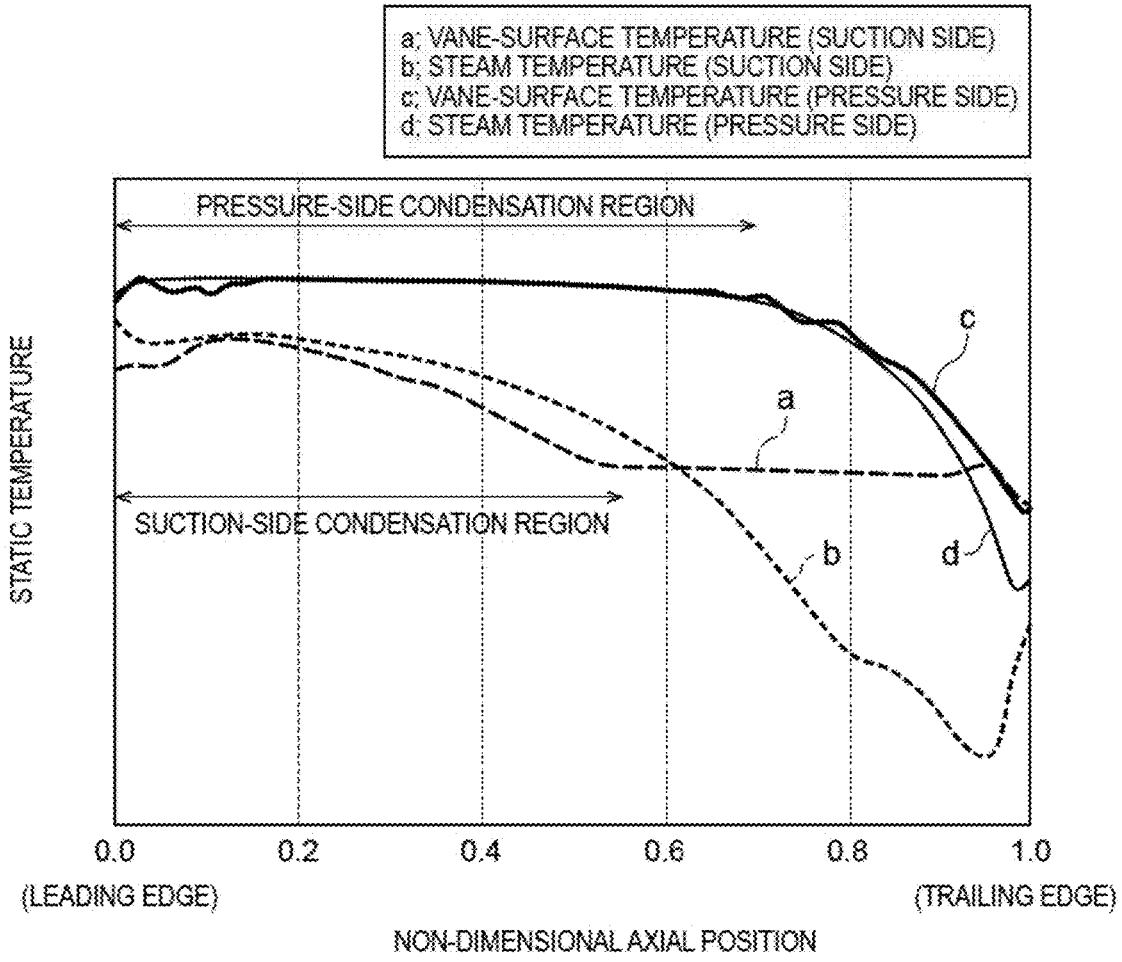
FIG. 5 is a chart showing the main steam temperature around stator vanes.

FIG. 4 is a diagram of the static temperature distribution (mean cross section) of the main steam St around stator vanes. FIG. 5 is a diagram showing distribution of the static temperature of the main steam St around stator vanes and the temperature of the stator vane surface. As depicted in FIGS. 4 and 5, wall surface condensation occurs in the vane surface region $R_3$ where the vane surface temperature is not higher than the main steam temperature, and wall surface condensation does not occur in the vane surface region $R_4$ where the vane surface temperature is higher than the main steam temperature. The present inventors and the like found that, although there are individual differences depending on the arrangement of the stator vanes and the lateral cross-sectional shape, the occurrence region of wall surface condensation that ranges from the leading edge to the trailing edge is generally wider toward the trailing edge side on the pressure-side surface than on the suction-side surface.

Figure 3:
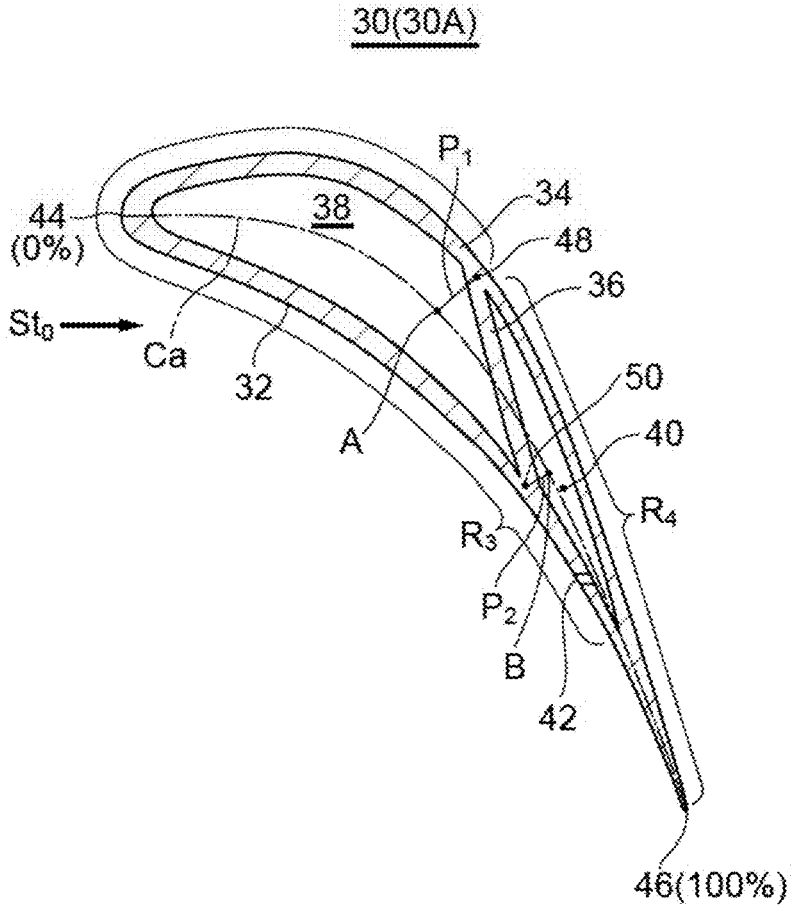
FIG. 3 is a lateral cross-sectional view of a stator vane according to an embodiment.

For the stator vane 30 (30A to 30D), as depicted in FIG. 3, inside the airfoil cross section, the hollow section 38 is disposed corresponding to the vane surface region $R_3$, and the hollow section 40 is disposed corresponding to the vane surface region $R_4$. Furthermore, by supplying a heating fluid to the hollow section 38, it is possible to suppress wall surface condensation that occurs in the vane surface region $R_3$ over the entire vane surface region $R_3$. Furthermore, the hollow section 40 needs to have a lower pressure than the main steam St in order to suck in the main steam St from the slit 42. The saturation temperature of moisture steam decreases with a pressure decrease, and thus the fluid temperature of the hollow section 40 decreases with respect to the main steam St. The wall surface condensation does not occur in the vane surface region $R_4$ even when the fluid temperature in the hollow section 40 decreases, and thus there is no risk of enhancing wall surface condensation. Furthermore, the vane surface region $R_4$ without wall surface condensation is not heated entirely, and thus the heat efficiency does not deteriorate.

For the stator vane 30 (30A to 30D), a suction-side connection portion 48 connecting the division wall 36 and the suction-side partition wall 34 is configured to be positioned closer to the leading edge than the pressure-side connection portion 50 connecting the division wall 36 and the pressure-side partition wall 32. Accordingly, it is possible to form the hollow section 38 in the vane surface region $R_3$ where wall surface condensation occurs, and position the hollow section 40 in the vane surface region $R_4$ where wall surface condensation does not occur.

In the present embodiment, as depicted in FIG. 3, the division wall 36 may have a linear shape that is oblique to the camber line Ca of the airfoil cross section (line connecting positions at the same distance from the pressure-side surface to the suction-side surface). Accordingly, it is possible to simplify the configuration of the division wall 36.

In an embodiment, as depicted in FIG. 3, when the position of the leading edge 44 is a 0% position and the position of the trailing edge 46 is a 100% position on the camber line Ca, the position of the intersection between the camber line Ca and a normal $P_1$ to the camber line Ca passing through the suction-side connection portion 48 is an A % position, and the position of the intersection between the camber line Ca and a normal $P_2$ to the camber line Ca passing through the pressure-side connection portion 50 is a B % position, a relationship B−A>10% is satisfied. Accordingly, it is possible to position the suction-side connection portion 48 of the division wall 36 closer to the leading edge 44 than the pressure-side connection portion 50, thereby forming the hollow section 38 so as to correspond to the vane surface region $R_3$ where wall surface condensation occurs, and forming the hollow section 40 so as to correspond to the vane surface region $R_4$ where wall surface condensation does not occur.

In an embodiment, on the basis of FIG. 5, the A % position is 30 to 60%, and the B % position is 50 to 80%. Accordingly, it is possible to exert the effect to suppress wall surface condensation in the region where wall surface condensation occurs.

Second Embodiment

Figure 6:
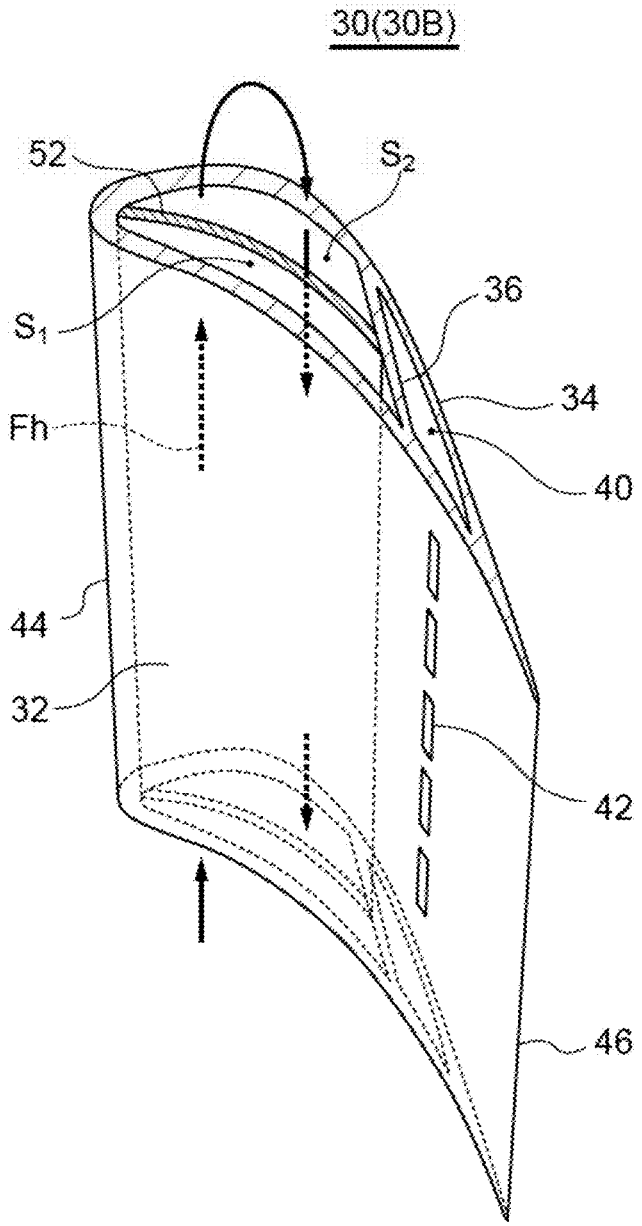
FIG. 6 is a perspective view of a stator vane according to an embodiment.

The stator vane 30 (30B) according to an embodiment further includes, as depicted in FIG. 6, a division wall 52 (second division wall) dividing the hollow section 38 into a pressure-side space $S_1$ closer to the pressure-side partition wall 32 and a suction-side space $S_2$ closer to the suction-side partition wall 34. Furthermore, the pressure-side space $S_1$ serves as an outgoing passage for the heating fluid Fh and the suction-side space $S_2$ serves as a returning passage for the heating fluid Fh.

The temperature of the main steam St around the stator vane is higher at the pressure-side surface, where the main steam St directly hits, than at the suction-side surface. Thus, when the heating fluid Fh is caused to flow uniformly to the hollow section 38, the suction-side partition wall 34 becomes over heated, which may cause deterioration of the heat efficiency. According to the present embodiment, the pressure-side space $S_1$ serves as the outgoing passage for the heating fluid Fh and the suction-side space $S_2$ serves as the returning passage for the heating fluid Fh, whereby the heating fluid Fh has a higher temperature when flowing through the pressure-side space $S_1$ than when flowing through the suction-side space $S_2$. Accordingly, it is possible to increase the temperature of the pressure-side surface compared to the suction-side surface. Thus, it is possible to suppress wall surface condensation in the vane surface region $R_3$ efficiently and suppress over heating of the suction-side partition wall 34, which makes it possible to suppress deterioration of heat efficiency.

In an embodiment, as depicted in FIGS. 1 and 6, the heating fluid Fh is supplied to the pressure-side space $S_1$ from the side of the casing 12 (the side of the vane root portion of the stator vane), U-turns at the side of the vane tip of the stator vane 30 (30B), and flows into the suction-side space $S_2$. The stator vane 30 (30B) is fixed to a support portion such as a radially-inner side diaphragm (not depicted) at the vane tip portion. With the end portion of the division wall 52 being shortened toward the vane root portion at the vane tip portion, it is possible to form a flow passage of the heating fluid Fh inside the vane body of the stator vane 30 (30B). Accordingly, it is no longer necessary to form a flow passage of the heating fluid Fh inside the radially-inner side diaphragm, and it is possible to simplify the configuration of the radially-inner side diaphragm.

Third Embodiment

Figure 7:
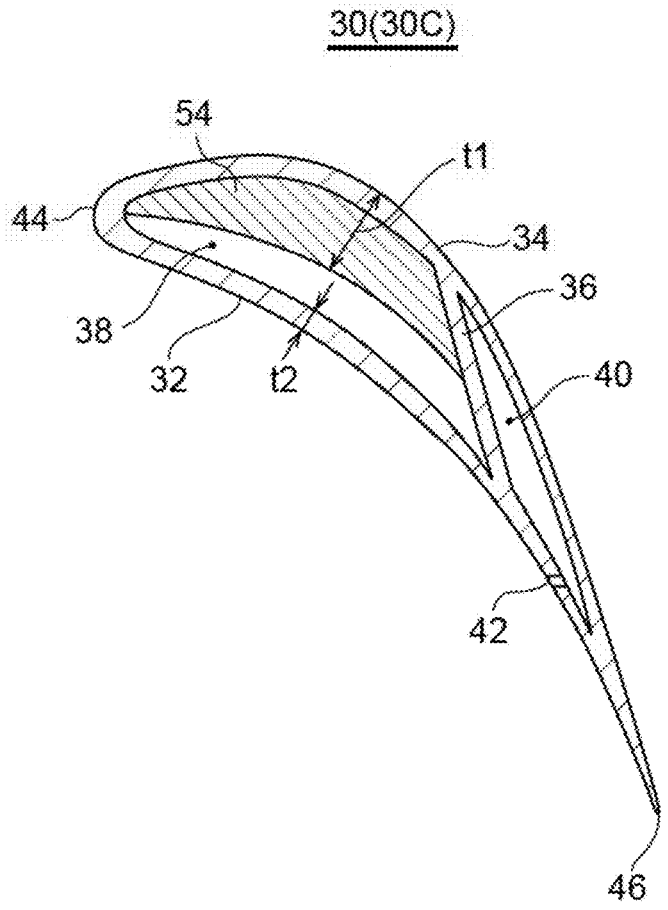
FIG. 7 is a lateral cross-sectional view of a stator vane according to an embodiment.

The stator vane 30 (30C) according to an embodiment is, as depicted in FIG. 7, configured such that the thickness t1 of the suction-side partition wall 34 forming the hollow section 38 is greater than the thickness t2 of the pressure-side partition wall 32 forming the hollow section 38. Accordingly, it is possible to reduce the quantity of heat transmitted to the suction-side surface from the heating fluid Fh compared to the quantity of heat transmitted to the pressure-side surface. Accordingly, it is possible to suppress over-heating of the suction-side surface, and suppress deterioration of the heat efficiency.

In an embodiment, as depicted in FIG. 7, a filling member 54 formed of a material different from the suction-side partition wall 34 may be disposed on the inner surface of the suction-side partition wall 34, such that the total thickness t1 of the suction-side partition wall 34 and the filling member 54 is greater than the thickness t2 of the pressure-side partition wall 32. According to the above embodiment, by selecting the filling member 54 having a desirable heat conductivity, it is possible to control the heat conductivity amount of the heating fluid Fh to the suction-side surface to a desirable value.

Fourth Embodiment

Figure 8:
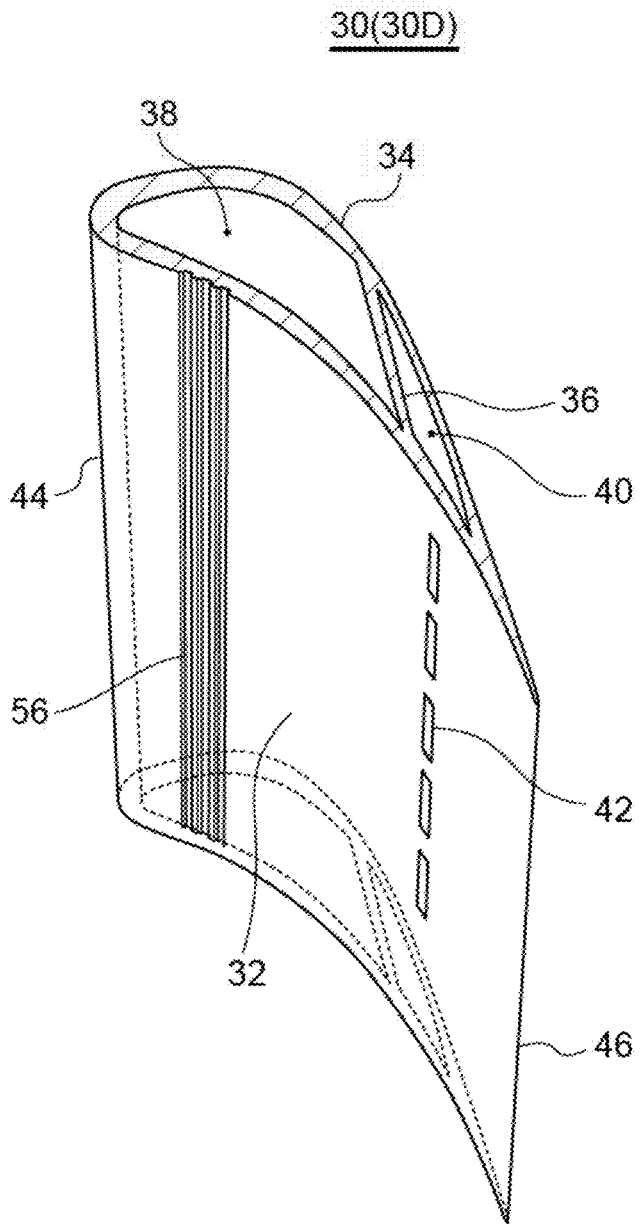
FIG. 8 is a perspective view of a stator vane according to an embodiment.
Figure 9:
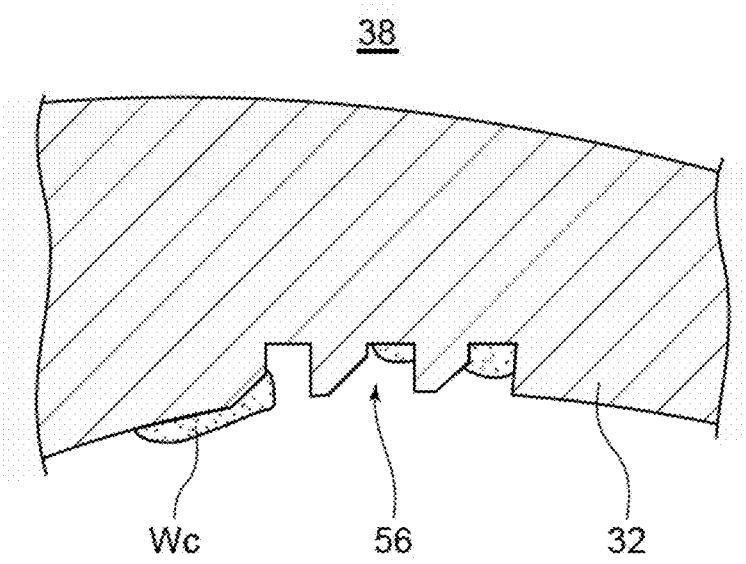
FIG. 9 is a partially-enlarged lateral cross-sectional view of a stator vane according to an embodiment.

The stator vane 30 (30D) according to an embodiment is, as depicted in FIGS. 8 and 9, configured such that an uneven portion 56 is formed on an outer surface of at least one of the pressure-side partition wall 32 or the suction-side partition wall 34 forming the hollow section 38. By forming the uneven portion 56, it is possible to increase the surface area of the pressure-side partition wall 32 or the suction-side partition wall 34, and thus it is possible to increase the evaporation amount of the coarse droplets Wc formed on the pressure-side surface or the suction-side surface. Accordingly, it is possible to reduce the amount of coarse droplets Wc that scatter toward the downstream side from the trailing edge of the stator vane.

In the embodiment depicted in FIGS. 8 and 9, the uneven portion 56 includes lengths of uneven portions that extend linearly along the vane height direction (direction from the vane root portion toward the vane tip portion) of the vane body. The uneven portion is formed on the outer surface of the pressure-side partition wall 32 that belongs to the vane surface region $R_3$, inside which the hollow section 38 is formed. Accordingly, with the uneven portion 56 formed on the outer surface of the pressure-side partition wall 32 belonging to the vane surface region $R_3$ where wall surface condensation is active and each recessed portion having a rectangular cross-section, it is possible to increase the storage amount of coarse droplets Wc. Thus, it is possible to take in a large amount of coarse droplets Wc into the uneven portion 56 and increase the evaporation amount. Furthermore, since the uneven portion extends over the entire vane height in the vane height direction, it is possible to take in the entire amount of coarse droplets Wc that move from the leading edge side to the trailing edge side along the pressure-side surface, into the uneven portion.

Fifth Embodiment

Figure 10:
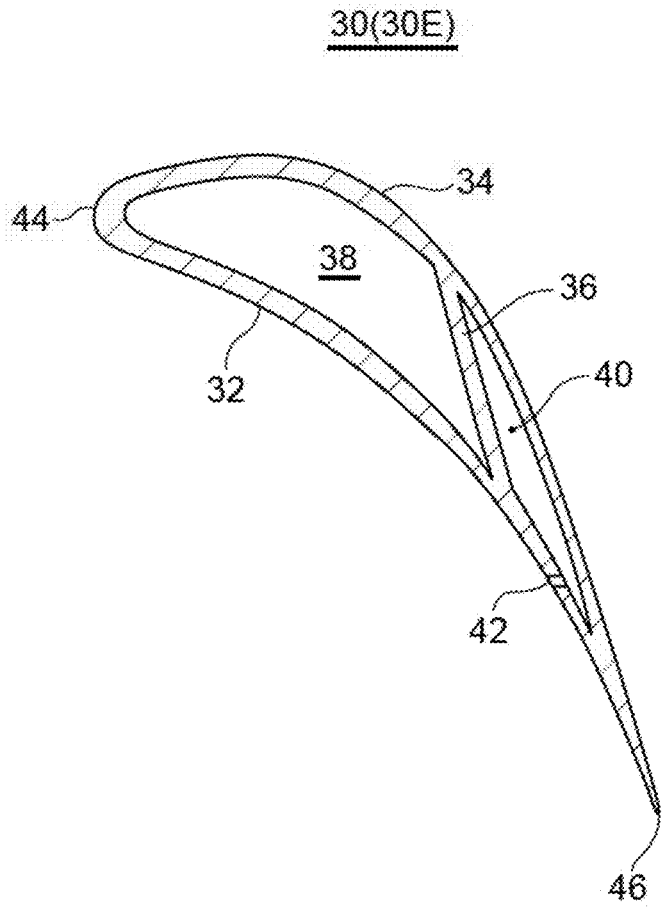
FIG. 10 is a lateral cross-sectional view of a stator vane according to an embodiment.
Figure 11:
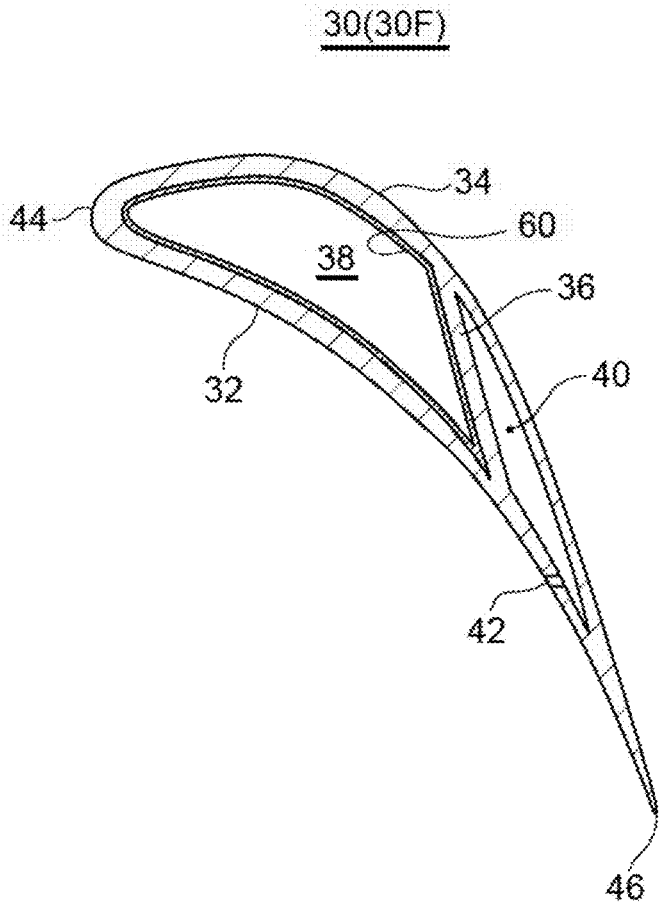
FIG. 11 is a lateral cross-sectional view of a stator vane according to an embodiment.
Figure 12:
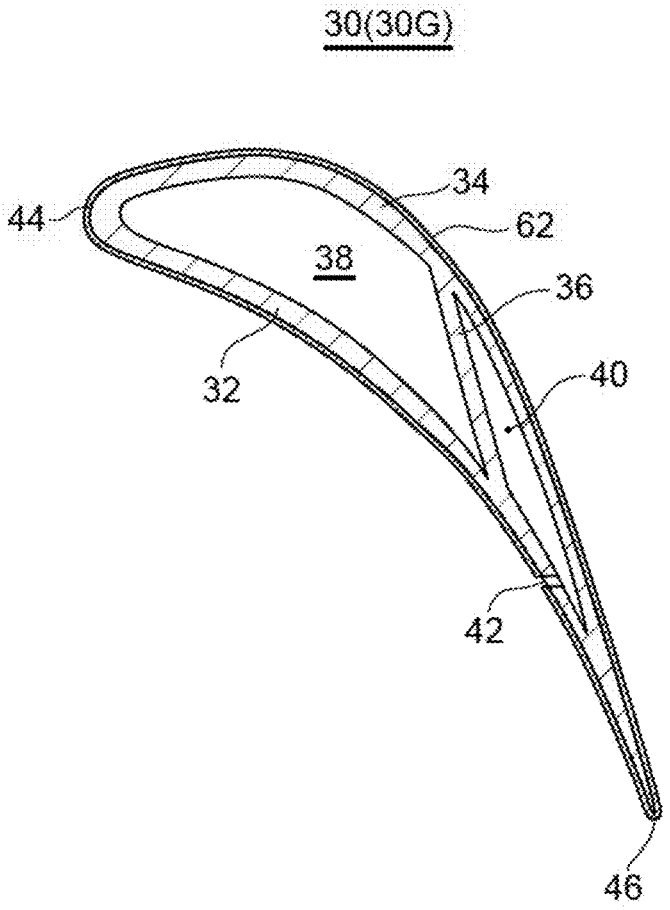
FIG. 12 is a lateral cross-sectional view of a stator vane according to an embodiment.

According to some embodiments, the stator vane 30 (30E, 30F, 30G) is, as depicted in FIGS. 10 to 12, for instance, disposed at the downstream side of the steam flow passage formed inside the casing 12, and has an airfoil cross section that includes a pressure-side partition wall 32 having a concave surface shape and a suction-side partition wall 34 having a convex surface shape. The vane body of the stator vane 30 (30E to 30G) includes a hollow section formed between the inner surface of the pressure-side partition wall 32 and the inner surface of the suction-side partition wall 34. The hollow section is divided by a division wall 36 (first division wall) into a hollow section 38 (first hollow section) positioned at the leading edge side and a hollow section 40 (second hollow section) positioned at the trailing edge side. The hollow section 38 is configured to be a closed space, and a slit 42 is formed on at least one of the pressure-side partition wall 32 or the suction-side partition wall 34, and the slit 42 is in communication with the hollow section 40.

According to the above embodiments, with the hollow section 38 being a closed space, it is possible to suppress formation of coarse droplets Wc or a liquid film on the stator vane surface, thanks to the potential heat of gas sealed in the hollow section 38. Furthermore, the coarse droplets Wc adhering to the stator vane surface flow into the hollow section 40 from the slit 42, and are removed from the stator vane surface. Furthermore, with the heat insulation effect of the gas sealed in the hollow section 38, heat transmission between the pressure-side partition wall 32 and the suction-side partition wall 34 is suppressed, and thus it is possible to maintain the temperature of the pressure-side partition wall 32 to be higher than that of the suction-side partition wall 34. Accordingly, it is possible to suppress wall surface condensation in the vane surface region $R_3$ which has a large area on the pressure-side surface, and suppress over heating of the suction-side partition wall 34, which makes it possible to suppress deterioration of heat efficiency. Furthermore, compared to the stator vane 30 (30A to 30D), it is unnecessary to supply the heating fluid Fh, and it is only necessary to seal a gas in the hollow section 38. Thus, it is possible to omit the configuration for supplying the heating fluid Fh to the hollow section 38.

As the gas sealed in the hollow section 38, air is used, for instance, but the gas may be an inert gas, for instance. Furthermore, the sealed gas should preferably have a pressure that is equivalent to the pressure of the main steam St, in order to prevent an unnecessary load from being applied to the pressure-side partition wall 32 and the suction-side partition wall 34 of the vane body.

In an embodiment, the stator vane 30 (30E to 30G) has a division wall 36 having the same configuration as that of the stator vane 30 (30A to 30D).

Sixth Embodiment

The stator vane 30 (30F) according to an embodiment is, as depicted in FIG. 11, configured such that an adiabatic membrane 60 (the first hollow-section side adiabatic membrane) is formed on an inner surface of at least one of the pressure-side partition wall 32 or the suction-side partition wall 34 forming the hollow section 38. According to the present embodiment, the stator vane 30 (30F) includes the adiabatic membrane 60, and thus it is possible to improve the effect to suppress heat transmission between the pressure-side partition wall 32 and the suction-side partition wall 34. Accordingly, by creating a temperature difference between the pressure-side surface and the suction-side surface, it is possible to suppress wall surface condensation on the pressure-side partition wall 32 with a large area of the vane surface region $R_3$, and suppress over heating of the suction-side partition wall 34, which makes it possible to suppress deterioration of heat efficiency.

In the embodiment depicted in FIG. 11, the adiabatic membrane 60 is formed on the entire inner surface of the pressure-side partition wall 32 and the suction-side partition wall 34 forming the hollow section 38, and thus it is possible to improve the heat insulation effect between the pressure-side partition wall 32 and the suction-side partition wall 34 even further. Furthermore, the adiabatic membrane 60 is also disposed on the wall surface of the division wall 36 dividing the hollow section 38, and thus it is possible to suppress transmission of the potential heat of the heating fluid Fh to the hollow section 40 having a lower temperature via the division wall 36.

Seventh Embodiment

The stator vane 30 (30G) for a steam turbine according to an embodiment is, as depicted in FIG. 12, configured such that an outer-surface side adiabatic membrane 62 is formed on an outer surface of at least one of the pressure-side partition wall 32 or the suction-side partition wall 34. According to the present embodiment, it is possible to suppress heat transfer in the vicinity of the vane surface with the outer-surface side adiabatic membrane 62. Accordingly, it is possible to suppress the cooling effect at the side of the vane surface with respect to the moisture steam $St_0$ around the vane surface, and thus it is possible to suppress wall surface condensation.

In the embodiment depicted in FIG. 12, the outer-surface side adiabatic membrane 62 is formed over the entire region of the stator vane surface except for the opening of the slit 42. Accordingly, it is possible to suppress heat transfer in the vicinity of the vane surface over the entire region of the stator vane surface, and suppress a temperature decrease of the pressure-side partition wall 32 of the region where the hollow section 40 is formed, and thus it is possible to suppress wall surface condensation in the region. Furthermore, the outer-surface side adiabatic membrane 62 may be formed only on the outer surfaces of the pressure-side partition wall 32 and the suction-side partition wall 34 that form the hollow section 38. Accordingly, it is possible to suppress heat transfer at the pressure-side partition wall 32 and the suction-side partition wall 34 where the hollow section 38 is formed, and thus it is possible to suppress wall surface condensation in this region.

Furthermore, the adiabatic membrane 60, the outer-surface side adiabatic membrane 62, and the adiabatic membranes 64 and 66 described below include, for instance, an adiabatic sheet having a heat insulation property or an adiabatic coating having a heat insulation property.

Eighth Embodiment

Figure 13:
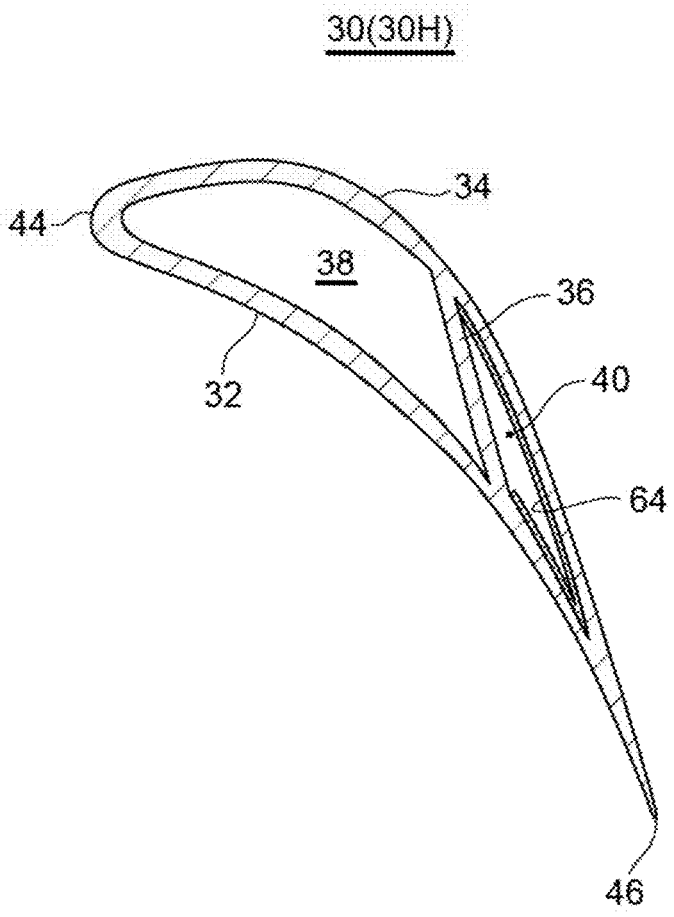
FIG. 13 is a lateral cross-sectional view of a stator vane according to an embodiment.

The hollow section 40 sucks in coarse droplets We and a liquid film through the slit 42, and thus has a lower pressure than the main steam. The saturation temperature of moisture steam decreases following a pressure decrease, and thus the fluid temperature of the hollow section 40 decreases with respect to the main steam. The stator vane 30 (30H) according to an embodiment is, as depicted in FIG. 13, configured such that an adiabatic membrane 64 (the second hollow-section side adiabatic membrane) is formed on the inner surface of at least one of the pressure-side partition wall 32 or the suction-side partition wall 34 forming the hollow section 40. Accordingly, it is possible to suppress cooling of the stator vane surface due to heat transmission to the hollow section 40, and thus it is possible to suppress wall surface condensation on the stator vane surface (especially, outer surface of the pressure-side partition wall 32).

In the embodiment depicted in FIG. 13, the adiabatic membrane 64 is formed on the inner surfaces of both of the pressure-side partition wall 32 and the suction-side partition wall 34 forming the hollow section 40, and thus it is possible to suppress cooling of the stator vane surface due to heat transmission to the hollow section 40, at both of the pressure-side partition wall 32 and the suction-side partition wall 34. Accordingly, it is possible to suppress wall surface condensation over the entire vane surface.

Furthermore, the adiabatic membrane 64 applied to the stator vane 30 (30H) can be applied to each of the stator vanes 30 (30A to 30G) depicted in FIGS. 2 to 12.

Ninth Embodiment

Figure 14:
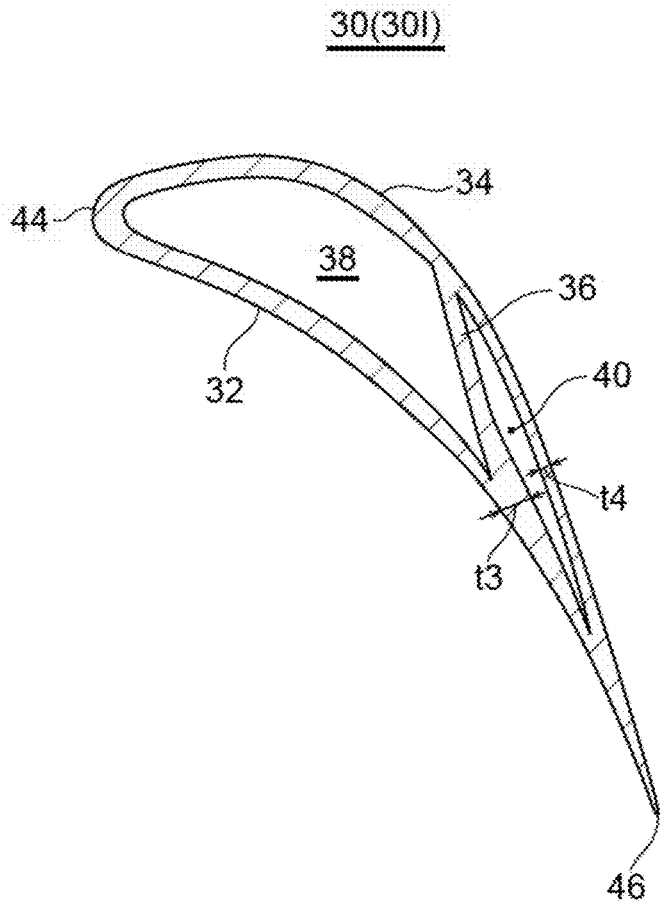
FIG. 14 is a lateral cross-sectional view of a stator vane according to an embodiment.

The stator vane 30 (30I) according to an embodiment is, as depicted in FIG. 14, configured such that the thickness t3 of the pressure-side partition wall 32 forming the hollow section 40 is greater than the thickness t4 of the suction-side partition wall 34 forming the hollow section 40. Accordingly, it is possible to suppress transmission of the low fluid temperature of the hollow section 40 to the pressure-side partition wall 32, and thus it is possible to reduce the amount of coarse droplets formed due to wall surface condensation.

In an embodiment, $t3 \geq 1.5 \cdot t4$. Accordingly, it is possible to improve the effect to suppress heat transmission between the pressure-side partition wall 32 and the hollow section 40.

Furthermore, the partition wall applied to the stator vane 30 (300 can be applied to each of the stator vanes 30 (30A to 30H) depicted in FIGS. 2 to 13.

Tenth Embodiment

Figure 15:
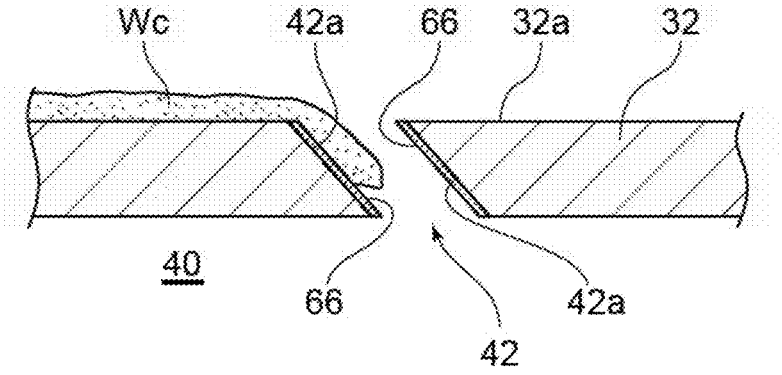
FIG. 15 is a partially-enlarged lateral cross-sectional view of a stator vane according to an embodiment.

In an embodiment, as depicted in FIG. 15, the adiabatic membrane 66 (slit adiabatic membrane) is formed on a slit facing surface 42*a* of the pressure-side partition wall 32 or the suction-side partition wall 34 on which the slit 42 is formed. By forming the adiabatic membrane 66, it is possible to suppress heat transmission between coarse droplets and the pressure-side partition wall 32 or the suction-side partition wall 34 on the slit facing surface 42*a*, and thereby it is possible to suppress acceleration of wall surface condensation at the slit facing surface 42*a*.

In the embodiment depicted in FIG. 15, the slit 42 is formed on the pressure-side partition wall 32 where inertia adhesion of coarse droplets often occurs. When the coarse droplets Wc generated on the outer surface 32*a* of the pressure-side partition wall 32 flow into the slit 42, the adiabatic membrane 66 suppresses heat transmission between the coarse droplets Wc and the pressure-side partition wall 32 at the slit facing surface 42*a*, and thereby it is possible to suppress acceleration of wall surface condensation.

(Method of Heating a Stator Vane for a Steam Turbine)

Figure 16:
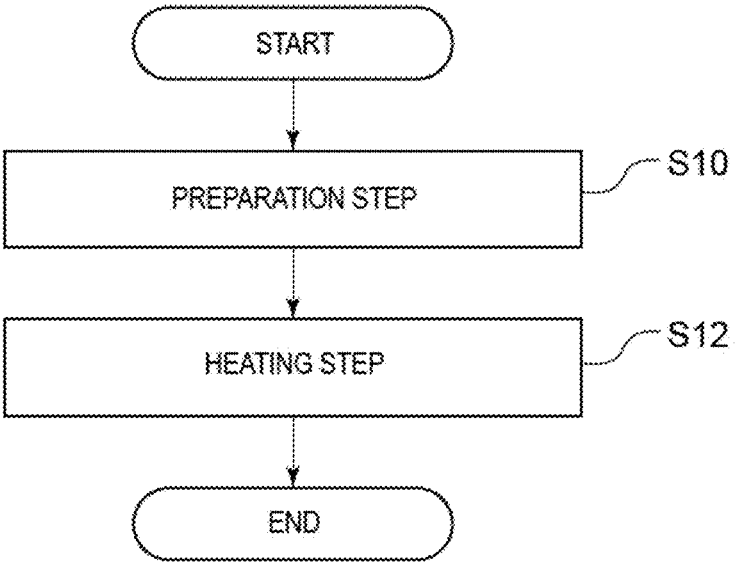
FIG. 16 is a flowchart of a method of heating a stator vane according to an embodiment.

A method of heating a stator vane for a steam turbine according to an embodiment includes, as depicted in FIG. 16, as a preparation step $S_1$, placing, in the steam flow passage of the steam turbine 10, a stator vane including a vane body having an airfoil cross section including a pressure-side partition wall 32 having a concave surface shape and a suction-side partition wall 34 having a convex surface shape, the vane body having a hollow section formed between an inner surface of the pressure-side partition wall 32 and an inner surface of the suction-side partition wall 34, and a division wall 36 dividing the hollow section into a hollow section 38 positioned at a leading edge side and a hollow section 40 positioned at a trailing edge side, wherein a slit 42 is formed on at least one of the pressure-side partition wall 32 or the suction-side partition wall 34, the slit 42 being in communication with the hollow section 40, like the stator vane 30 (30A to 30I). Furthermore, the method includes supplying the heating fluid Fh to the hollow section 38 of the stator vane disposed in the steam flow passage (heating step S12).

According to the above method, by supplying the heating fluid Fh to the hollow section 38 and heating the stator vane surface, it is possible to suppress an increase in the size of droplets that develop due to wall surface condensation or the like, and coarse droplets Wc formed on the stator vane surface are sucked into the hollow section 40 through the slit 42. Thus, it is possible to suppress moisture loss and erosion of rotor blades due to the coarse droplets Wc.

The features described in the above respective embodiments can be understood as follows, for instance.

(1) According to an embodiment, a stator vane for a steam turbine includes: a vane body having an airfoil cross section including a pressure-side partition wall (for instance, the pressure-side partition wall 32) having a concave surface shape and a suction-side partition wall (for instance, the suction-side partition wall 34) having a convex surface shape, the vane body having a hollow section formed between an inner surface of the pressure-side partition wall and an inner surface of the suction-side partition wall; and a first division wall (for instance, the division wall 36) dividing the hollow section into a first hollow section (for instance, the hollow section 38) positioned at a leading edge side and a second hollow section (for instance, the hollow section 40) positioned at a trailing edge side, wherein the first hollow section is configured to be supplied with a fluid (for instance, the heating fluid Fh), and a slit (for instance, the slit 42) is formed on at least one of the pressure-side partition wall or the suction-side partition wall, the slit being in communication with the second hollow section.

Mainly at the stator vane surface at the leading edge side, which is hit by main steam having a higher temperature than the temperature of the stator vane surface, the main steam is cooled by the stator vane surface, and wall surface condensation is likely to occur on the stator vane surface. With the above configuration, the heating fluid is supplied to the first hollow section formed inside the stator vane surface where wall surface condensation is likely to occur, and the stator vane surface is heated. Accordingly, it is possible to suppress wall surface condensation effectively. Furthermore, mainly on the suction-side surface at the trailing edge side, the temperature of the main steam decreases, and the vane surface has a higher temperature than the main steam temperature, and thus basically wall surface condensation does not occur. The liquid film formed by wall surface condensation on the stator vane surface at the leading edge side or the liquid film formed from accumulation of coarse droplets that scatter from the upstream side moves toward the trailing edge along the stator vane surface, flows into the second hollow section through the slit formed on the vane surface at the trailing edge side, and is removed from the stator vane surface. With the above effects, it is possible to suppress scattering of the coarse droplets to the downstream side from the trailing edge of the stator vane, and thereby it is possible to suppress moisture loss and erosion of the rotor blades due to scattering of the coarse droplets.

(2) According to another embodiment, the stator vane for a steam turbine according to the above (1) further includes: a second division wall (for instance, the division wall 52) dividing the first hollow section into a pressure-side space (for instance, the pressure-side space $S_1$) closer to the pressure-side partition wall and a suction-side space (for instance, the suction-side space $S_2$) closer to the suction-side partition wall, wherein the pressure-side space is configured to be an outgoing passage of the fluid and the suction-side space is configured to be a returning passage of the fluid.

The temperature of the main steam around the stator vane is higher at the pressure side, where the main steam directly hits, than at the suction side. Thus, to suppress wall surface condensation on the vane surface, it is necessary to increase the temperature at the pressure-side surface compared to the suction-side surface. Thus, when the heating fluid is caused to flow uniformly to the first hollow section, the suction-side partition wall becomes over heated, which may cause deterioration of the heat efficiency. According to the above embodiment, the first hollow section is divided by the second division wall, the pressure-side space serves as an outgoing flow passage of the heating fluid, and the suction-side space serves as a returning passage of the heating fluid, such that a heating fluid has a lower temperature when flowing through the suction-side space than when flowing through the pressure-side space. Accordingly, it is possible to suppress over-heating of the suction-side space, and thereby suppress deterioration of the heat efficiency.

(3) According to yet another embodiment, the stator vane for a steam turbine according to the above (1) is configured such that the suction-side partition wall forming the first hollow section has a greater thickness (for instance, the thickness t1) than the thickness (for instance, thickness t2) of the pressure-side partition wall forming the first hollow section.

Accordingly, it is possible to reduce the quantity of heat transmitted to the suction-side surface from the heating fluid compared to the quantity of heat transmitted to the pressure-side surface. Accordingly, it is possible to suppress over-heating of the suction-side surface, and suppress deterioration of the heat efficiency.

(4) According to yet another embodiment, the stator vane for a steam turbine according to any one of the above (1) to (3) is configured such that an uneven portion (for instance, the uneven portion 56) is formed on an outer surface of at least one of the pressure-side partition wall or the suction-side partition wall forming the first hollow section.

With the above configuration, by increasing the surface area of the pressure-side surface or the suction-side surface by forming the uneven portion, it is possible to increase the evaporation amount of coarse droplets formed on the stator vane surface. Accordingly, it is possible to suppress the amount of coarse droplets that scatter toward the downstream side from the trailing edge of the stator vane.

(5) According to yet another embodiment, a stator vane for a steam turbine includes: a vane body having an airfoil cross section including a pressure-side partition wall having a concave surface shape and a suction-side partition wall having a convex surface shape, the vane body having a hollow section formed between an inner surface of the pressure-side partition wall and an inner surface of the suction-side partition wall; and a first division wall dividing the hollow section into a first hollow section positioned at a leading edge side and a second hollow section positioned at a trailing edge side, wherein the first hollow section is configured to be a closed space, and a slit is formed on at least one of the pressure-side partition wall or the suction-side partition wall, the slit being in communication with the second hollow section.

With the above configuration, it is possible to suppress formation of coarse droplets or a liquid film on the stator vane surface thanks to the potential heat of a gas sealed in the first hollow section being a closed space. Furthermore, coarse droplets formed on the stator vane surface at the leading edge side or the liquid film formed from accumulation of coarse droplets moves toward the trailing edge along the stator vane surface, flows into the second hollow section through the slit formed on the vane surface at the trailing edge side, and is removed from the stator vane surface. With the above effects, it is possible to suppress scattering of the coarse droplets to the downstream side from the trailing edge of the stator vane, and thereby it is possible to suppress moisture loss and erosion of the rotor blades due to scattering of the coarse droplets. Furthermore, with the heat insulation effect of the gas sealed in the first hollow section, it is possible to suppress transmission of heat of the pressure side to the suction-side partition wall. Accordingly, it is possible to suppress over-heating of the suction-side partition wall, and suppress deterioration of the heat efficiency.

(6) According to yet another embodiment, the stator vane for a steam turbine according to the above (5) further includes a first hollow-section side adiabatic membrane (for instance, the adiabatic membrane 60) formed on an inner surface of at least one of the pressure-side partition wall or the suction-side partition wall forming the first follow section.

With the above configuration, the first hollow-section side adiabatic membrane is formed, and thus it is possible to prevent the temperature of the suction-side steam having a lower temperature than the pressure-side steam from being transmitted to the pressure side, and it is possible to suppress acceleration of wall surface condensation at the pressure side.

(7) According to yet another embodiment, the stator vane for a steam turbine according to the above (5) or (6) further includes an outer side adiabatic membrane (for instance, the outer-surface side adiabatic membrane 62) formed on an outer surface of at least one of the pressure-side partition wall or the suction-side partition wall.

With the above configuration, it is possible to suppress heat transmission in the vicinity of the vane surface with the outer-surface side adiabatic membrane. Accordingly, it is possible to suppress the cooling effect at the side of the vane surface with respect to the main steam around the vane surface, and thus it is possible to suppress wall surface condensation.

(8) According to yet another embodiment, the stator vane for a steam turbine according to any one of the above (1) to (7) further includes a second hollow-section side adiabatic membrane (for instance, the adiabatic membrane 64) formed on an inner surface of at least one of the pressure-side partition wall or the suction-side partition wall forming the second hollow section.

The second hollow section sucks in coarse droplets and a liquid film through the slit, and thus has a lower pressure than the main steam. The saturation temperature of moisture steam decreases following a pressure decrease, and thus the fluid temperature of the second hollow section decreases. With the above configuration, the first hollow-section side adiabatic membrane is provided, and thus it is possible to suppress transmission of the low fluid temperature of the second hollow section to the stator vane surface. Accordingly, it is possible to suppress wall surface condensation of the stator vane surface.

(9) According to yet another embodiment, the stator vane for a steam turbine according to any one of the above (1) to (8) is configured such that the pressure-side partition wall forming the second hollow section has a greater thickness (for instance, the thickness t3) than the thickness (for instance, the thickness t4) of the suction-side partition wall forming the second hollow section.

With the above configuration, it is possible to suppress transmission of the low fluid temperature of the second hollow section to the pressure-side surface, and thus it is possible to reduce the amount of coarse droplets formed due to wall surface condensation.

(10) According to yet another embodiment, the stator vane for a steam turbine according to any one of the above (1) to (9) further includes a slit adiabatic membrane (for instance, the adiabatic membrane 66) formed on a slit facing surface of a partition wall on which the slit is formed.

With the above configuration, with the slit adiabatic membrane provided, it is possible to suppress heat transfer at the slit facing surface, and thereby it is possible to suppress progress of wall surface condensation at the slit facing surface.

(11) According to yet another embodiment, the stator vane for a steam turbine according to any one of the above (1) to (10) is configured such that a suction-side connection portion (for instance, the suction-side connection portion 48) connecting the first division wall and the suction-side partition wall is configured to be positioned closer to a leading edge than a pressure-side connection portion (for instance, the pressure-side connection portion 50) connecting the first division wall and the pressure-side partition wall.

As described above, wall surface condensation occurs in a region where the main steam temperature is higher than the temperature of the stator vane surface, such as the stator vane surface at the leading edge side, while wall surface condensation does not occur in a region where the vane surface temperature is higher than the main steam temperature, such as the stator vane surface at the trailing edge side. Further, it is necessary to form the first hollow section in the region where wall surface condensation occurs and form the second hollow section in the region where wall surface condensation does not occur. With the above configuration, the suction-side connection portion of the first division wall is positioned closer to the leading edge than the pressure-side connection portion, and thereby it is possible to form the first hollow section in the region where wall surface condensation occurs, and the second hollow section in the region where wall surface condensation does not occur.

(12) According to yet another embodiment, the stator vane for a steam turbine according to the above (11) is configured such that when a position of the leading edge is a 0% position and a position of a trailing edge is a 100% position on a camber line (for instance, the camber line Ca) of the airfoil cross section, a position of an intersection between the camber line and a normal (for instance, the normal $P_1$) to the camber line passing through the suction-side connection portion is a A % position, and a position of an intersection between the camber line and a normal (for instance, the normal $P_2$) to the camber line passing through the pressure-side connection portion is a B % position, a relationship B−A>10% is satisfied.

With the above configuration, it is possible to position the suction-side connection portion of the first division wall closer to the leading edge than the pressure-side connection portion. Accordingly, it is possible to form the first hollow section in the region where wall surface condensation occurs and form the second hollow section in the region where wall surface condensation does not occur.

(13) According to an embodiment, a steam turbine (for instance, the steam turbine 10) includes: a turbine stage including a stator vane row (for instance, the stator vane row 22) having a plurality of stator vanes (for instance, the stator vanes 30) disposed around a turbine rotor (for instance, the turbine rotor 16), and a rotor blade row (for instance, the rotor blade row 24) including a plurality of rotor blades disposed around the turbine rotor at a downstream side of the stator vane row with respect to a flow direction of a working fluid, and at least a part of the plurality of stator vanes forming the stator vane row includes the stator vane for a steam turbine according to any one of the above (1) to (12).

With the above steam turbine, at least a part of the plurality of stator vanes forming the stator vane row includes the stator vane for a steam turbine having the above configuration, and thus it is possible to suppress an increase in the size of droplets formed on the stator vane surface, and thereby it is possible to suppress moisture loss and erosion of the rotor blades due to scattering of the coarse droplets from the trailing edge to the downstream side.

(14) According to an embodiment, a method of heating a stator vane for a steam turbine, includes a preparation step (for instance, the preparation step S10) of placing, in a steam flow passage of a steam turbine, a stator vane for a steam turbine including a vane body having an airfoil cross section including a pressure-side partition wall having a concave surface shape and a suction-side partition wall having a convex surface shape, the vane body having a hollow section formed between an inner surface of the pressure-side partition wall and an inner surface of the suction-side partition wall; and a first division wall dividing the hollow section into a first hollow section positioned at a leading edge side and a second hollow section positioned at a trailing edge side, wherein a slit is formed on at least one of the pressure-side partition wall or the suction-side partition wall, the slit being in communication with the second hollow section; and a heating step (for instance, the heating step S12) of supplying a heating liquid to the first hollow section.

According to the above method, by supplying the heating fluid to the first hollow section and heating the stator vane surface, it is possible to suppress an increase in the size of droplets that develop due to wall surface condensation or the like, and coarse droplets formed on the stator vane surface flow into the second hollow section through the slit to be removed from the stator vane surface. Accordingly, it is possible to suppress moisture loss and erosion of the rotor blades due to scattering of the coarse droplets from the trailing edge (for instance, the trailing edge 46) of the stator vane of the downstream side.

The invention claimed is:

1. A stator vane for a steam turbine, comprising:

a vane body having an airfoil cross section including a pressure-side partition wall having a concave surface shape and a suction-side partition wall having a convex surface shape, the vane body having a hollow section formed between an inner surface of the pressure-side partition wall and an inner surface of the suction-side partition wall;

a first division wall dividing the hollow section into a first hollow section positioned at a leading edge side and a second hollow section positioned at a trailing edge side; and a second division wall dividing the first hollow section into a pressure-side space closer to the pressure-side partition wall and a suction-side space closer to the suction-side partition wall, wherein the first hollow section is configured to be supplied with a fluid, and a slit is formed on at least one of the pressure-side partition wall or the suction-side partition wall, the slit being in communication with the second hollow section, and wherein the pressure-side space is configured to be an outgoing passage of the fluid and the suction-side space is configured to be a returning passage of the fluid.

2. A steam turbine, comprising:

a turbine stage including a stator vane row having a plurality of stator vanes disposed around a turbine rotor, and a rotor blade row including a plurality of rotor blades disposed around the turbine rotor at a downstream side of the stator vane row with respect to a flow direction of a working fluid, wherein at least a part of the plurality of stator vanes forming the stator vane row comprises the stator vane for a steam turbine according to claim 1.

3. A stator vane for a steam turbine, comprising:

a vane body having an airfoil cross section including a pressure-side partition wall having a concave surface shape and a suction-side partition wall having a convex surface shape, the vane body having a hollow section formed between an inner surface of the pressure-side partition wall and an inner surface of the suction-side partition wall; and a first division wall dividing the hollow section into a first hollow section positioned at a leading edge side and a second hollow section positioned at a trailing edge side, wherein the first hollow section is configured to be supplied with a fluid, and a slit is formed on at least one of the pressure-side partition wall or the suction-side partition wall, the slit being in communication with the second hollow section, and wherein a suction-side connection portion connecting the first division wall and the suction-side partition wall is configured to be positioned closer to a leading edge than a pressure-side connection portion connecting the first division wall and the pressure-side partition wall.

4. The stator vane for a steam turbine according to claim 3, wherein, when a position of the leading edge is a 0% position and a position of a trailing edge is a 100% position on a camber line of the airfoil cross section, a position of an intersection between the camber line and a normal to the camber line passing through the suction-side connection portion is a A % position, and a position of an intersection between the camber line and a normal to the camber line passing through the pressure-side connection portion is a B % position, a relationship B %−A %>10% is satisfied.

5. A steam turbine, comprising:

a turbine stage including a stator vane row having a plurality of stator vanes disposed around a turbine rotor, and a rotor blade row including a plurality of rotor blades disposed around the turbine rotor at a downstream side of the stator vane row with respect to a flow direction of a working fluid, wherein at least a part of the plurality of stator vanes forming the stator vane row comprises the stator vane for a steam turbine according to claim 3.

6. A steam turbine, comprising:

a turbine stage including a stator vane row having a plurality of stator vanes disposed around a turbine rotor, and a rotor blade row including a plurality of rotor blades disposed around the turbine rotor at a downstream side of the stator vane row with respect to a flow direction of a working fluid, wherein at least a part of the plurality of stator vanes forming the stator vane row comprises a stator vane for a steam turbine, comprising:

a vane body having an airfoil cross section including a pressure-side partition wall having a concave surface shape and a suction-side partition wall having a convex surface shape, the vane body having a hollow section formed between an inner surface of the pressure-side partition wall and an inner surface of the suction-side partition wall; and a first division wall dividing the hollow section into a first hollow section positioned at a leading edge side and a second hollow section positioned at a trailing edge side, wherein the first hollow section is configured to be supplied with a fluid, and a slit is formed on at least one of the pressure-side partition wall or the suction-side partition wall, the slit being in communication with the second hollow section, and wherein the first division wall is configured so that a fluid is incapable of flowing between the first hollow section and second hollow section, wherein the steam turbine further comprises a fluid introduction pipe for supplying the fluid to the first hollow section.

* * * * *